US012018552B2

(12) United States Patent
Terán et al.

(10) Patent No.: US 12,018,552 B2
(45) Date of Patent: Jun. 25, 2024

(54) METHODS AND APPARATUS FOR UNDERBALANCE CONDITION ASSURANCE IN DEPLETED VOLATILE OIL RESERVOIRS

(71) Applicant: SAUDI ARABIAN OIL COMPANY, Dhahran (SA)

(72) Inventors: Juan Manuel Polo Terán, Dhahran (SA); Paolo Ilham Sola Gratia, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/459,629

(22) Filed: Aug. 27, 2021

(65) Prior Publication Data

US 2023/0060157 A1 Mar. 2, 2023

(51) Int. Cl.

| | |
|---|---|
| ***E21B 43/12*** | (2006.01) |
| ***E21B 23/06*** | (2006.01) |
| ***E21B 34/14*** | (2006.01) |

(52) U.S. Cl.

CPC ..... *E21B 43/124* (2013.01); *E21B 23/06* (2013.01); *E21B 34/142* (2020.05)

(58) Field of Classification Search

CPC ..... E21B 43/124; E21B 23/06; E21B 34/142
See application file for complete search history.

(56) References Cited

U.S. PATENT DOCUMENTS

| | | | | |
|---|---|---|---|---|
| 4,410,041 | A | 10/1983 | Davies et al. | |
| 4,474,241 | A * | 10/1984 | Freeman | E21B 21/10 137/71 |
| 6,250,389 | B1 * | 6/2001 | Sudol | E21B 37/00 166/222 |
| 2008/0115934 | A1 * | 5/2008 | Pettinato | E21B 49/087 166/254.1 |
| 2015/0000982 | A1 * | 1/2015 | Mcdowell | E21B 34/10 175/57 |
| 2016/0273347 | A1 | 9/2016 | Fipke et al. | |
| 2018/0149003 | A1 | 5/2018 | Xiao et al. | |

* cited by examiner

*Primary Examiner* — Nicole Coy
*Assistant Examiner* — Nicholas D Wlodarski
(74) *Attorney, Agent, or Firm* — Osha Bergman Watanabe & Burton LLP

(57) ABSTRACT

A method is disclosed that includes deploying a jet pump assembly from a surface location into a production tubing of a depleted volatile oil reservoir, the jet pump assembly including retractable tubing, a jet pump and a retractable packer operatively connected with the retractable tubing. The jet pump assembly is positioned within the production tubing, the retractable packer is engaged to bridge a space between the jet pump assembly and a surface of the production tubing, and the jet pump is activated to pump toward the surface location a mixture comprising a power fluid and reservoir fluid. The method further includes disengaging the retractable packer and determining whether there is an underbalance condition. Also disclosed are a related jet pump assembly and bi-directional valve arrangement. The valve arrangement includes upper and lower valves, and retains power fluid in retractable tubing during retraction of a jet pump assembly from production tubing.

9 Claims, 9 Drawing Sheets

METHODS AND APPARATUS FOR UNDERBALANCE CONDITION ASSURANCE IN DEPLETED VOLATILE OIL RESERVOIRS

BACKGROUND

In the oilfield arts, kick-off lifting is often undertaken with jet pumps, especially in oil producer wells with high reservoir pressure. However, such a method is usually not effective for depleted volatile oil reservoirs, which often require a more robust form of lifting in view of comparatively reduced reservoir pressures. In such cases, costly and cumbersome procedures such as nitrogen lifting are often involved, while less costly and less complicated alternatives have remained highly elusive.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method which includes deploying a jet pump assembly from a surface location into a production tubing of a depleted volatile oil reservoir, wherein the jet pump assembly includes: retractable tubing; and a jet pump and a retractable packer operatively connected with the retractable tubing. The jet pump assembly is positioned at a predetermined first position within the production tubing, the retractable packer is engaged to bridge a space between the jet pump assembly and a surface of the production tubing, and the jet pump is activated to: pump a power fluid through the retractable tubing; and pump toward the surface location a mixture comprising the power fluid and reservoir fluid. The method further includes disengaging the retractable packer and determining whether there is an underbalance condition.

In one aspect, embodiments disclosed herein relate to a jet pump assembly for kick-off lifting in a depleted volatile oil reservoir. The assembly includes retractable tubing, a jet pump and a retractable packer operatively connected with the retractable tubing. The retractable packer is deployable to bridge a space between the jet pump assembly and a surface of production tubing in a wellbore, and the jet pump is actuable to: pump a power fluid through the retractable tubing; and pump toward a surface location a mixture comprising the power fluid and reservoir fluid. The apparatus further includes a valve arrangement that retains the power fluid in the retractable tubing during retraction of the jet pump assembly from the production tubing.

In one aspect, embodiments disclosed herein related to a bi-directional valve arrangement for retractable tubing of a jet pump assembly used in kick-off lifting in a depleted volatile oil reservoir. The valve arrangement includes a housing, and an upper valve and a lower valve each mounted within the housing. The upper valve and lower valve are each displaceable between an open position and a closed position. The valve arrangement further includes a trigger that causes displacement of the upper valve from the open position to the closed position, and an activator which deploys in a direction from an upper portion of the housing toward the trigger, and interacts with the trigger to deploy the upper valve from the open position to the closed position. Additionally, the valve arrangement retains power fluid in the retractable tubing during retraction of the jet pump assembly from production tubing.

Other aspects and advantages of the claimed subject matter will be apparent from the following description and the appended claims.

DETAILED DESCRIPTION

Figure 1:
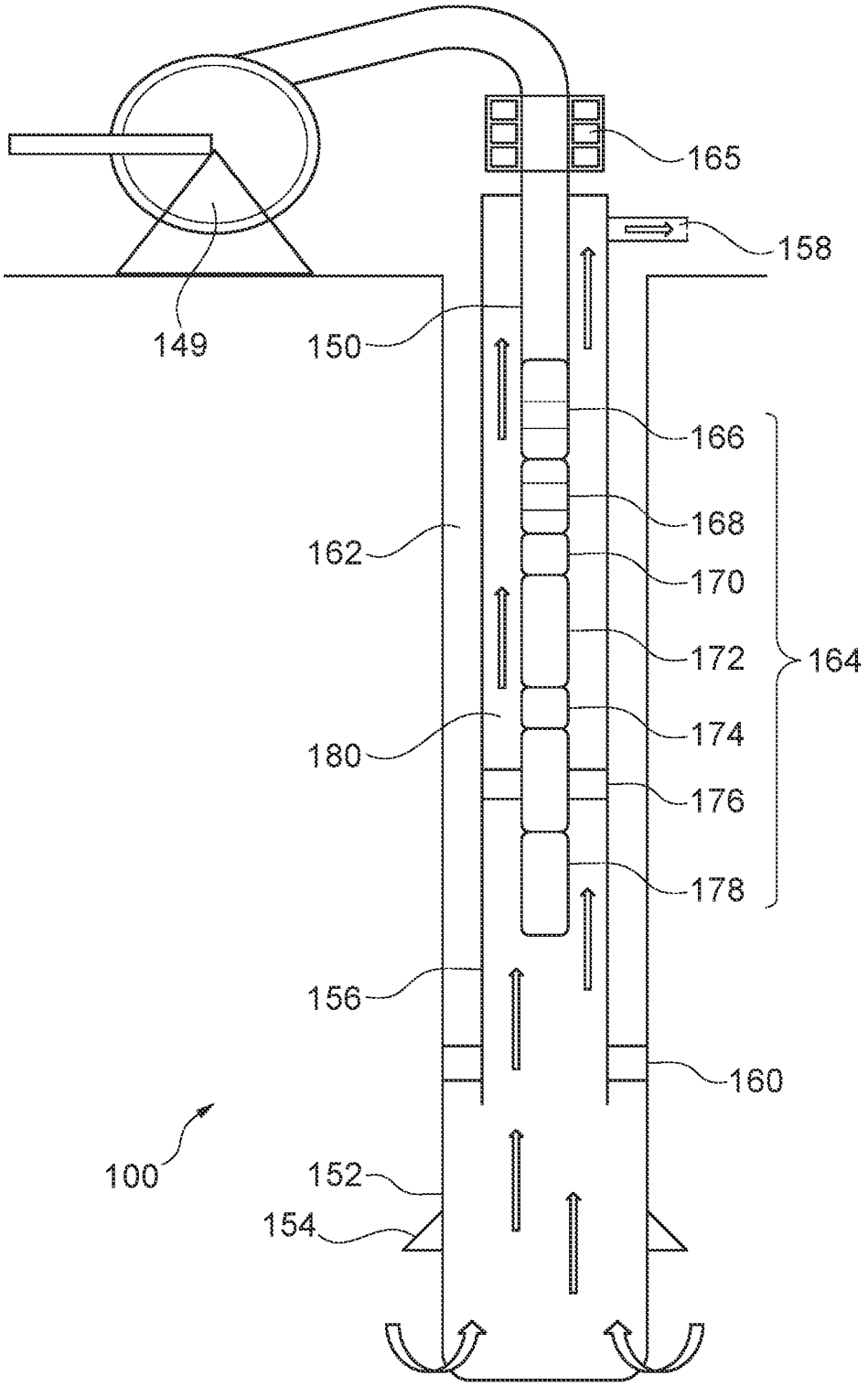
FIG. 1 schematically illustrates, in a cross-sectional elevational view, a system 100 in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Broadly described and contemplated herein, in accordance with one or more embodiments, are a system and method of using a jet pump for kick-off lifting in depleted volatile oil reservoirs, with surprising positive results. These may be employed during flow back, well lifting and well testing operations alike. Conventional disadvantages of employing a jet pump in such settings are obviated, wherein mixed power fluid ends up being fully removed from a wellbore, thereby permitting reservoir fluid to flow naturally. Sequential jet-pump lifting operations may be employed, as detailed herein.

Generally, in accordance with one or more embodiments, a jet pump assembly includes retractable tubing (e.g., coiled tubing) and a jet pump and retractable packer (e.g., thru-tubing packer) operatively connected with the retractable tubing (e.g., connected at a free end of the retractable tubing). The jet pump assembly is repositioned at different depths from deeper to shallower depths, with the jet pump then activated for kick-off lifting (i.e., where power fluid is pumped through the retractable tubing and into the jet pump).

Generally, in accordance with one or more embodiments, when the thru-tubing packer is repositioned, some of the mixture (of power fluid and reservoir fluid) previously formed in an annulus above the packer is effectively replaced by reservoir fluid below the packer. As the mixture of power fluid and reservoir fluid then occupies less volume—and defines a smaller hydrostatic column—above the thru-tubing packer, the hydrostatic pressure exerted by the mixture then lessens. A stepped process of repositioning the thru-tubing packer to shallower depths, and employing the jet pump for lifting, can continue until an underbalance condition (defined below) is created to permit the reservoir fluid to flow naturally. At that point, retractable tubing the coiled tubing can be pulled out of the wellbore along with the jet pump system. Particularly, the coiled tubing can be wet-retracted in a manner to be described in more detail herebelow.

Generally, in accordance with one or more embodiments, at each step of the overall process of repositioning the retractable packer to shallower depths, and employing the jet pump for lifting, a short verification step can assess the status of the process. As such, after stopping the jet pump the retractable packer can be temporarily disengaged or un-set; i.e., caused to retract in a radial direction, to effectively remove a physical boundary that previously contained the reservoir fluid below. If it is then determined that there is not yet a sufficient underbalance condition to permit free and natural flow of the reservoir fluid upwards, then the retractable tubing, jet pump and retractable packer and then moved up to a shallower depth, and the lifting and verification steps can be repeated. An "underbalance" condition may be defined as a condition where reservoir pressure (underneath) is sufficient to overcome hydrostatic pressure applied from above, e.g., by the annular column of the aforementioned "mixture" once the retractable packer has been disengaged.

The disclosure now turns to working examples of a system and method in accordance with one or more embodiments, as described and illustrated with respect to FIGS. 1-13. It should be understood and appreciated that these merely represent illustrative examples, and that a great variety of possible implementations are conceivable within the scope of embodiments as broadly contemplated herein. Further, to facilitate easier reference when describing FIGS. 1 through 13, reference numerals may be advanced by a multiple of 100 in indicating a similar or analogous component or element among FIGS. 1-13.

FIG. 1 schematically illustrates a system 100 in accordance with one or more embodiments. As shown, a reel 149 of retractable tubing (e.g., coiled tubing) 150 may be mounted at a surface location (e.g., fixed on the ground or on a truck). A casing 152 may be bored into the ground, and terminate at a flange 154. Thus, below the flange, reservoir fluids can progress into the casing 152, e.g., from a depleted volatile oil reservoir. Production tubing 156 may be nested within the casing and essentially be coaxial with respect thereto.

In accordance with one or more embodiments, production tubing 156 includes, at an upper end thereof, an outlet 158 for permitting reservoir fluids and/or other fluids to be removed from within the casing 152. At a lower end of production tubing 156, a packer 160 may be deployed to seal off an annular space 162 between an external surface of the production tubing 156 and an internal surface of the casing 152.

In accordance with one or more embodiments, an assembly 164 of downhole equipment is disposed at a free end of the coiled tubing 150 (which, itself may be guided downwardly via a suitable guide 165). The downhole assembly 164 may include, from top to bottom in the drawing, a motor head assembly (MHA) 166, a retention valve 168, a first crossover 170, a jet pump 172, a second crossover 174, a retractable packer (e.g., "CT-tubing packer") 176 and a downhole surveying tool 178.

In accordance with one or more embodiments, the retention valve 168 may be structured to facilitate "wet retraction" of the coiled tubing and downhole assembly 164 from production tubing 156, as discussed in more detail herebelow. As such, by way of an illustrative and non-restrictive example, retention valve 168 may be embodied by a bi-directional valve arrangement such as that described and illustrated herein with respect to FIGS. 9-11. The retractable packer 176, for its part, may be deployable from a retracted position to a position, as shown, where it bridges an annular space 180 between the downhole assembly 164 and an inner surface of the production tubing 156. Thus, when packer 176 is in the retracted position, fluid from below is free to progress upwardly through annular space 180.

The disclosure now turns to a working example of a system in accordance with one or more embodiments, and as shown iteratively via FIGS. 2-8, and with components similar to those shown in FIG. 1.

Figure 2:
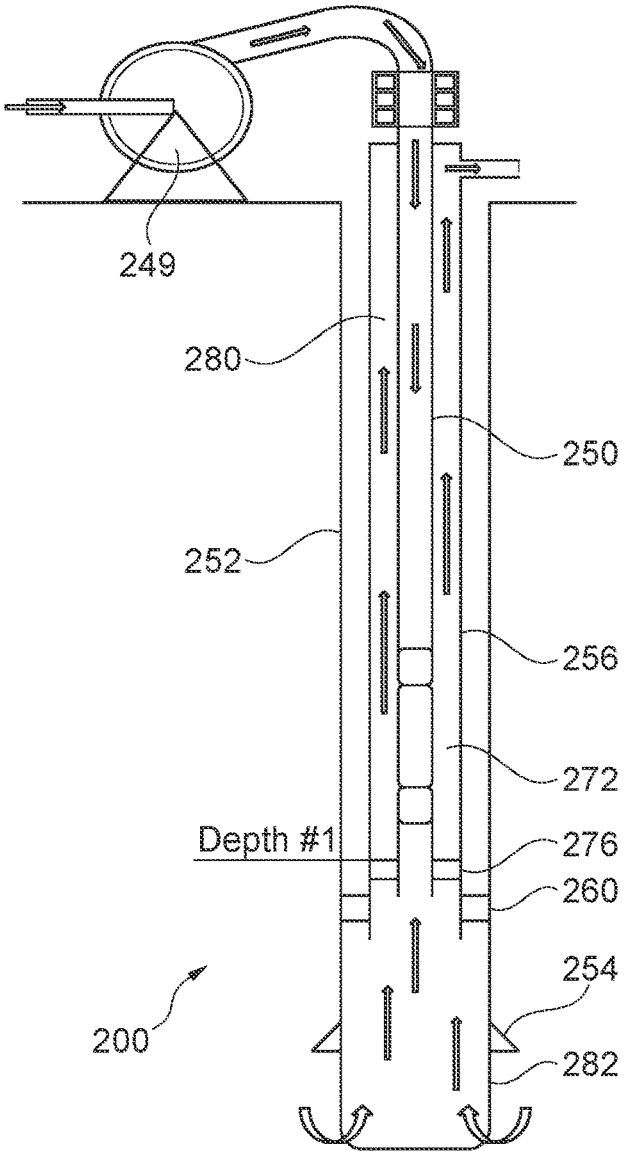
FIG. 2 schematically illustrates, in a cross-sectional elevational view, a working example of a system in a first condition.

As such, FIG. 2 schematically illustrates a working example of a system 200 in a first condition, in accordance with one or more embodiments. Here, retractable tubing 250 and jet pump 272 are deployed into production tubing 256, from the surface location where reel 249 is located. (Also shown, analogously to similar components in FIG. 1, are a casing 252, flange 254 and packer 260.) The "jet pump assembly" including retractable tubing 250, jet pump 272 and retractable packer 276 is positioned at a predetermined position within the production tubing; here, it is shown as "Depth #1". The retractable packer 276 is deployed such that it bridges the annular space 280 between retractable tubing 250 and the inner surface of production tubing 256 at "Depth #1". The jet pump 272 is then activated to (and generally is actuable, or can be activated, to) pump a power fluid through the retractable tubing 250 into the jet pump 272, and to pump toward the surface location a mixture which includes the power fluid and reservoir fluid (from open reservoir 282).

Figure 3:
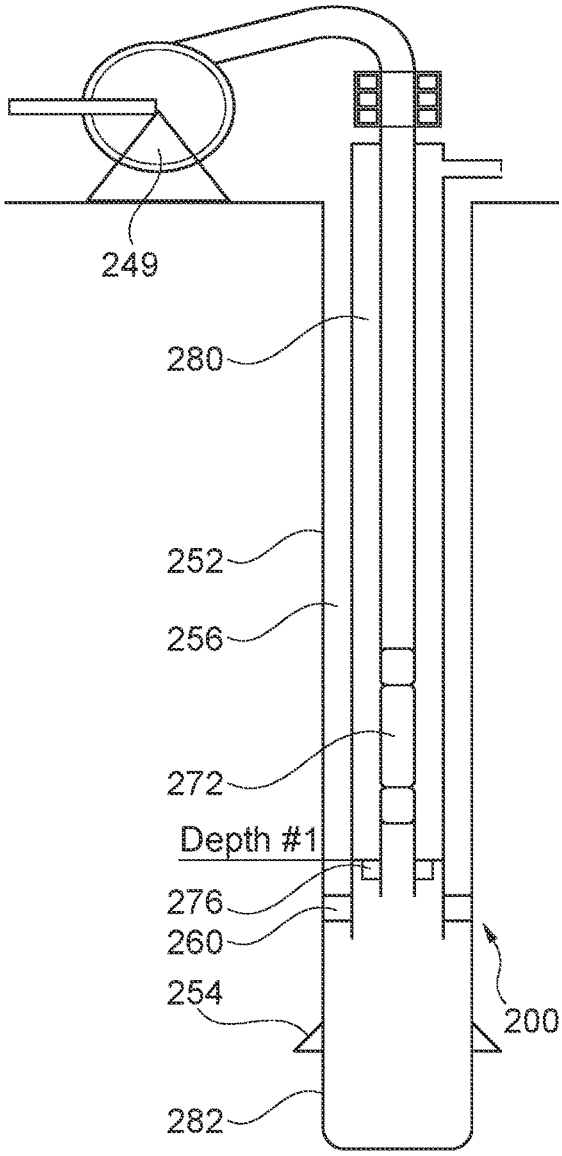
FIG. 3 schematically illustrates a working example of the system of FIG. 2 in a second condition.
Figure 4:
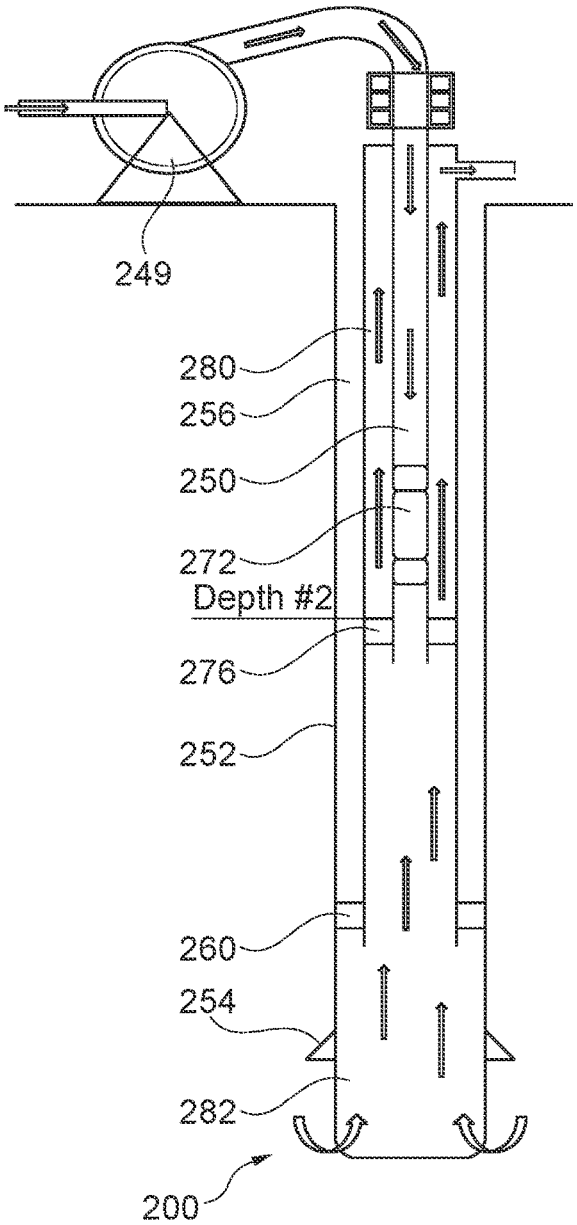
FIG. 4 which schematically illustrates a working example of the system of FIG. 2 in a third condition.

FIG. 3 schematically illustrates a working example of the system 200 of FIG. 2 in a second condition, in accordance with one or more embodiments. Here, the retractable packer 276 is retracted such that it does not fully bridge the annular space 280 between retractable tubing 250 and the inner surface of production tubing 256. A determination is then made as to whether there is an underbalance condition, where a reservoir pressure exceeds a hydrostatic pressure from the mixture. By way of an illustrative example, to make such a determination the well may be opened to check for any flow to confirm an underbalance condition In accordance with one or more embodiments, if an underbalance condition is not determined to be present, the jet pump 272 is deactivated and the jet pump assembly (250, 272, 276) is then repositioned to a second position within the production tubing, wherein the second position is closer to the surface location than is the first position. This is shown in FIG. 4, which schematically illustrates a working example of the system 200 of FIG. 2 in a third condition. Here, the retractable packer 276 is positioned at a "Depth #2", closer to the surface location than the aforementioned "Depth #1". (Thus, the jet pump 272 may be deactivated prior to or upon disengaging the retractable packer 276 in connection with repositioning the assembly 250/272/276.) The jet pump 272 is then activated again to pump a power fluid through the retractable tubing 250 into the jet pump 272, and to pump toward the surface location a mixture which includes the power fluid and reservoir fluid.

Figure 5:
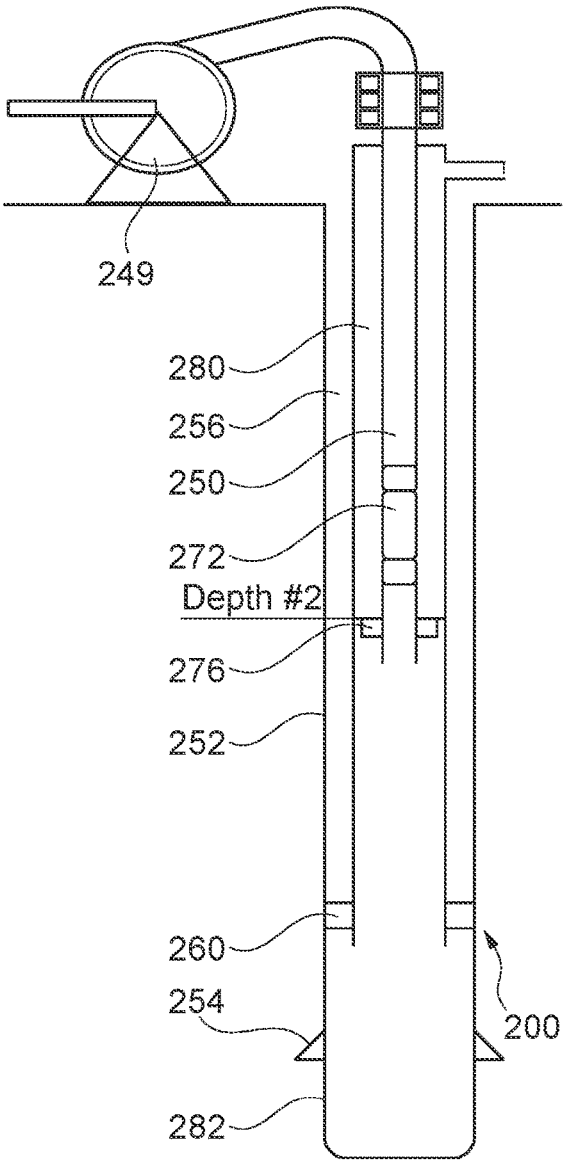
FIG. 5 schematically illustrates a working example of the system 200 of FIG. 2 in a fourth condition.

FIG. 5 schematically illustrates a working example of the system 200 of FIG. 2 in a fourth condition, in accordance with one or more embodiments. Here, the retractable packer 276 is again retracted such that it does not fully bridge the annular space 280 between retractable tubing 250 and the inner surface of production tubing 256. As with the example of FIG. 3, a determination is then made as to whether there is an underbalance condition, where a reservoir pressure exceeds a hydrostatic pressure from the mixture.

Figure 6:
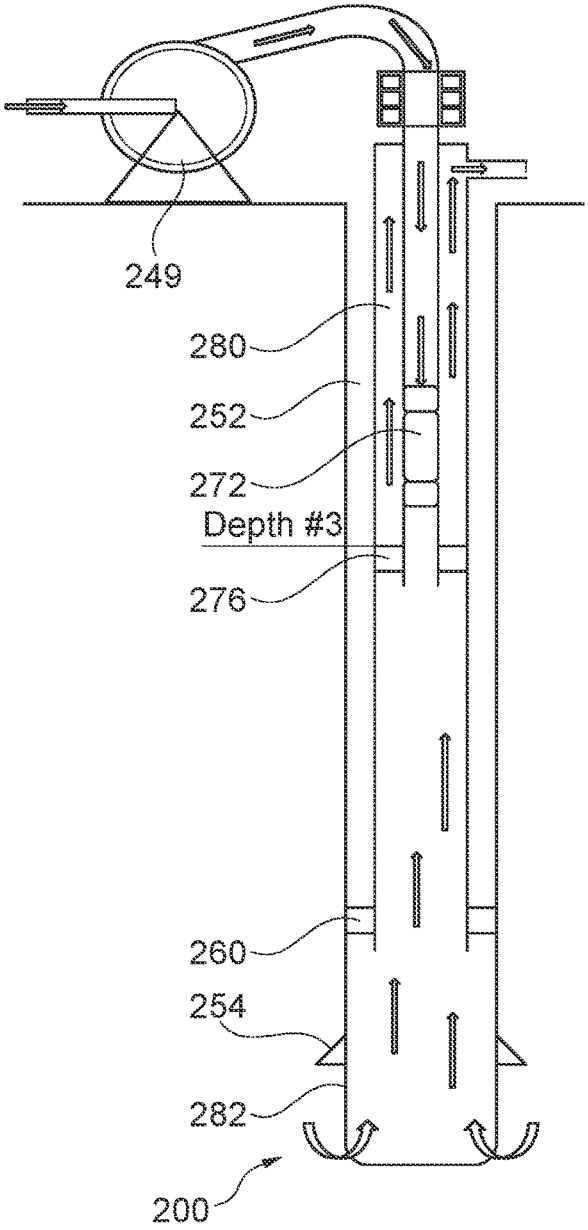
FIG. 6 schematically illustrates a working example of the system of FIG. 2 in a fifth condition, in accordance with one or more embodiments.

If an underbalance condition is again determined not to be present, the jet pump 272 is deactivated and the jet pump assembly (250, 272, 276) is then repositioned to a third position within the production tubing, wherein the third position is closer to the surface location than is the second position. This is shown in FIG. 6, which schematically illustrates a working example of the system 200 of FIG. 2 in a fifth condition. Here, the retractable packer 276 is positioned at a "Depth #3", closer to the surface location than the aforementioned "Depth #2". The jet pump 272 is then activated again to pump a power fluid through the retractable tubing 250 into the jet pump 272, and to pump toward the surface location a mixture which includes the power fluid and reservoir fluid.

Figure 7:
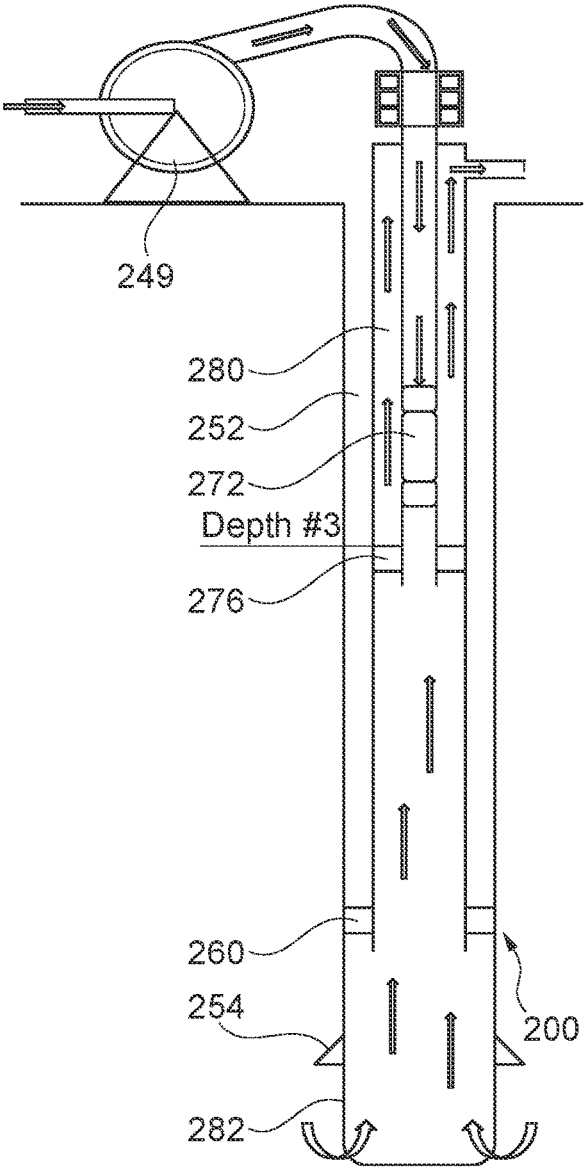
FIG. 7 schematically illustrates a working example of the system of FIG. 2 in a variant, sixth condition, in accordance with one or more embodiments.

FIG. 7 schematically illustrates a working example of the system 200 of FIG. 2 in a variant, sixth condition, in accordance with one or more embodiments. Here, based on one or more predetermined criteria, the power fluid may be replaced with a power fluid that is lighter in weight and/or density, such as diesel. It should be understood that this replacement may take place essentially at any time that the jet pump assembly (250, 272, 276) is repositioned, but—as illustrated in FIG. 7—may indeed be reserved for a later stage of the overall process described herein. Essentially any suitable criteria may be applied to determine whether or not to switch to a lighter power fluid such as diesel. By way of an illustrative and non-restrictive example, there may be a predetermined protocol for determining an optimum or suitable depth at which a switch may be made to the lighter power fluid. For instance, such a protocol may be based on measured reservoir pressure, and on flow behavior at the beginning of a flow from the reservoir.

As such, in accordance with one or more variant embodiments as illustrated in FIG. 7, the jet pump 272 is once again activated to pump the lighter power fluid through the retractable tubing 250 into the jet pump 272, and to pump toward the surface location a mixture which includes first the original power fluid and reservoir fluid. Continuing, and after the well is lifted for a short period, a new mixture including just the newer, lighter power fluid and reservoir fluid will then be pumped to the surface location.

Figure 8:
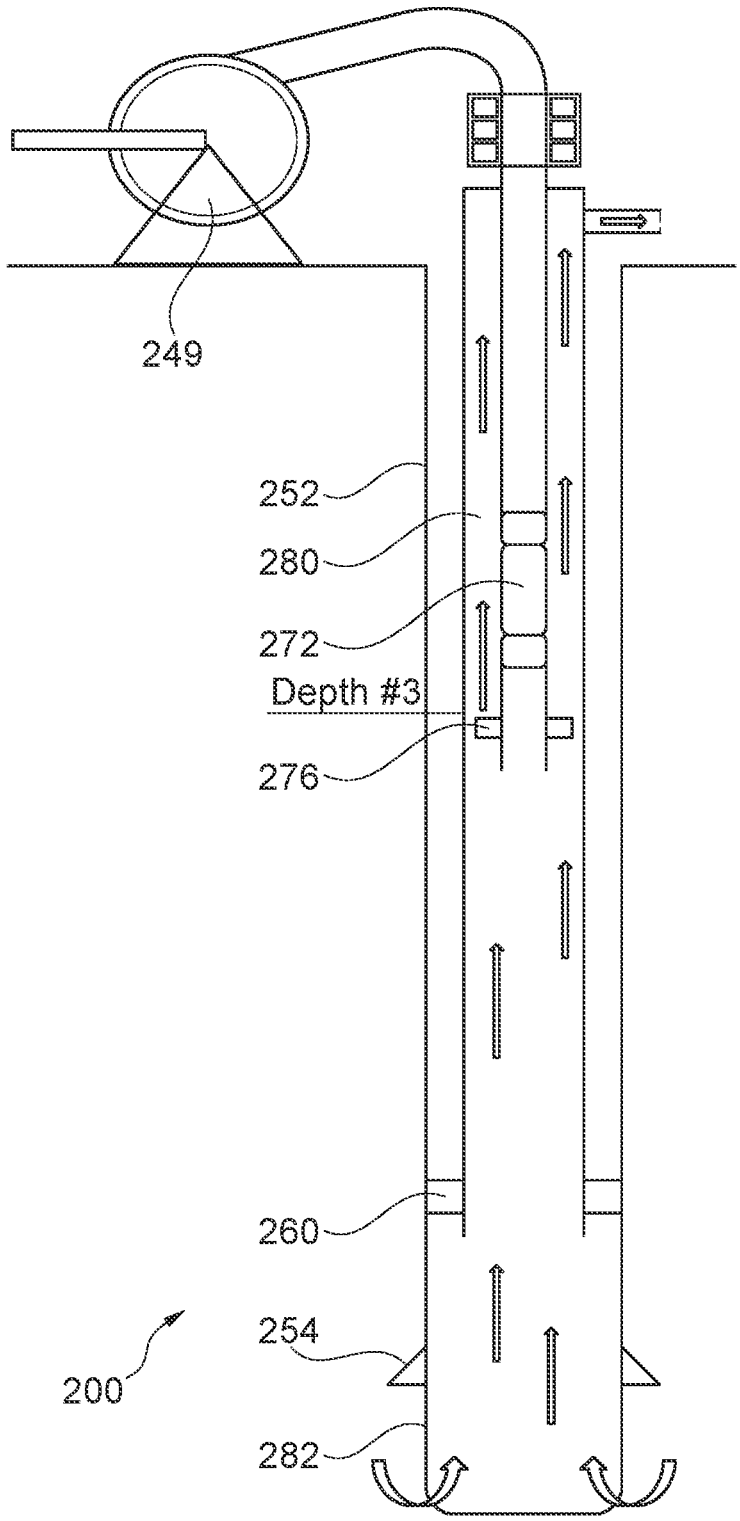
FIG. 8 schematically illustrates a working example of the system of FIG. 2 in a seventh condition.

FIG. 8 schematically illustrates a working example of the system 200 of FIG. 2 in a seventh condition. As such, whether or not the original power fluid has been replaced with a lighter power fluid, the retractable packer 276 is again retracted such that it does not fully bridge the annular space 280 between retractable tubing 250 and the inner surface of production tubing 256. As with the examples of FIGS. 3 and 5, a determination is then made as to whether there is an underbalance condition, where a reservoir pressure exceeds a hydrostatic pressure from the mixture. If it is determined here (or at earlier stages) that indeed an underbalance condition is present, and reservoir fluid is able to flow naturally toward the surface location, then the lifting operations may be considered complete.

Accordingly, in accordance with one or more embodiments, a process as broadly contemplated herein may proceed to a stage of equipment retraction/removal once an underbalance condition has been confirmed. As such, the retractable tubing 250 may then be "wet-retracted" out of the production tubing 256 and toward the surface location, such that power fluid (whether the original power fluid or the lighter power fluid discussed with respect to FIG. 7) is "carried" by the retractable tubing 250 during such retraction. This will avert a condition of permitting power fluid (of any type) to progress back into the wellbore.

In accordance with one or more embodiments, a jet pump assembly as broadly contemplated herein may include a valve arrangement which retains the power fluid in (or within) the retractable tubing during the wet-retraction of the jet pump assembly from the production tubing. As such, by way of a working example and again with reference to FIG. 1, a related retention valve 168 may be configured in a manner to facilitate such wet-retraction (i.e., ensure that power fluid does not progress back from the retractable tubing into the wellbore). As shown in FIG. 1, such a retention valve 168 may be operatively disposed between a motor head assembly 166 and jet pump 172. The disclosure now turns to a working example of such a retention valve in FIGS. 9-11, which may be referred to simultaneously.

Figure 9:
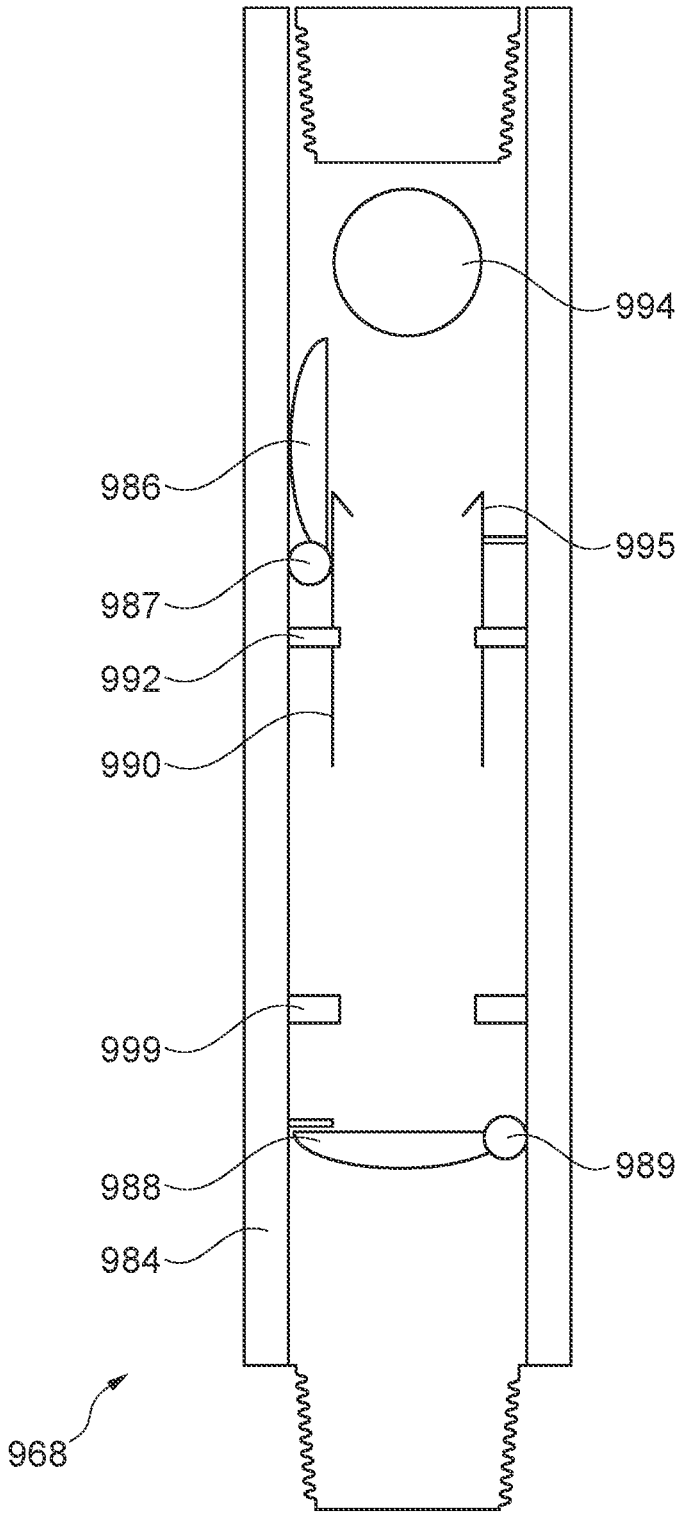
FIG. 9 schematically illustrates, in a cross-sectional elevational view, a retention valve in a first configuration, in accordance with one or more embodiments.

FIG. 9 schematically illustrates, in a cross-sectional elevational view, a retention valve 968 in a first configuration, in accordance with one or more embodiments. Valve 968 is a "bi-directional" valve arrangement. (The valve arrangement 968 may also be understood to be a "bi-directional, dual-flapper retention valve with an inverted ball activated shut-off system") As shown, valve 968 includes a housing 984, and an upper valve 986 and a lower valve 988 each mounted within the housing 984. The upper valve 986 and lower valve 988 are each displaceable between an open position and a closed position. In accordance with the present working example, upper and lower valves 986, 988 are embodied as flapper valves, each biased toward the closed position via a respective biasing hinge 987, 989.

In accordance with one or more embodiments, a "trigger" may be provided in the form of a locking sleeve 990 held in a place by a shear pin 992. In a manner to be described, this trigger (990/992) causes displacement of the upper valve 986 from the open position to the closed position (e.g., releases the holding of the upper valve 986 in the open position and permits the upper valve to displace from the open position to the closed position). Also, an activator may be provided in the form of an activation ball 994 which, in a manner to be described, deploys in a direction from an upper portion of the housing 984 toward the locking sleeve 990 and interacts with the "trigger" to deploy the upper valve 986 from the open position to the close position.

Figure 10:
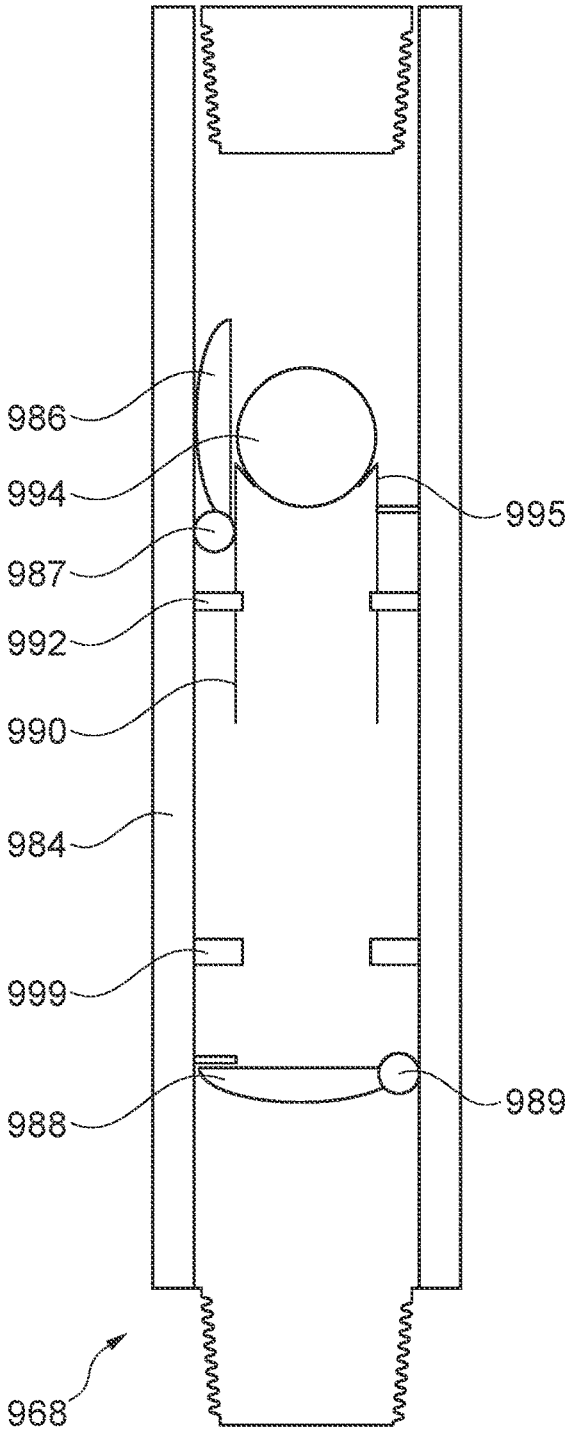
FIG. 10 schematically illustrates the retention valve of FIG. 9 in a second configuration, in accordance with one or more embodiments.
Figure 11:
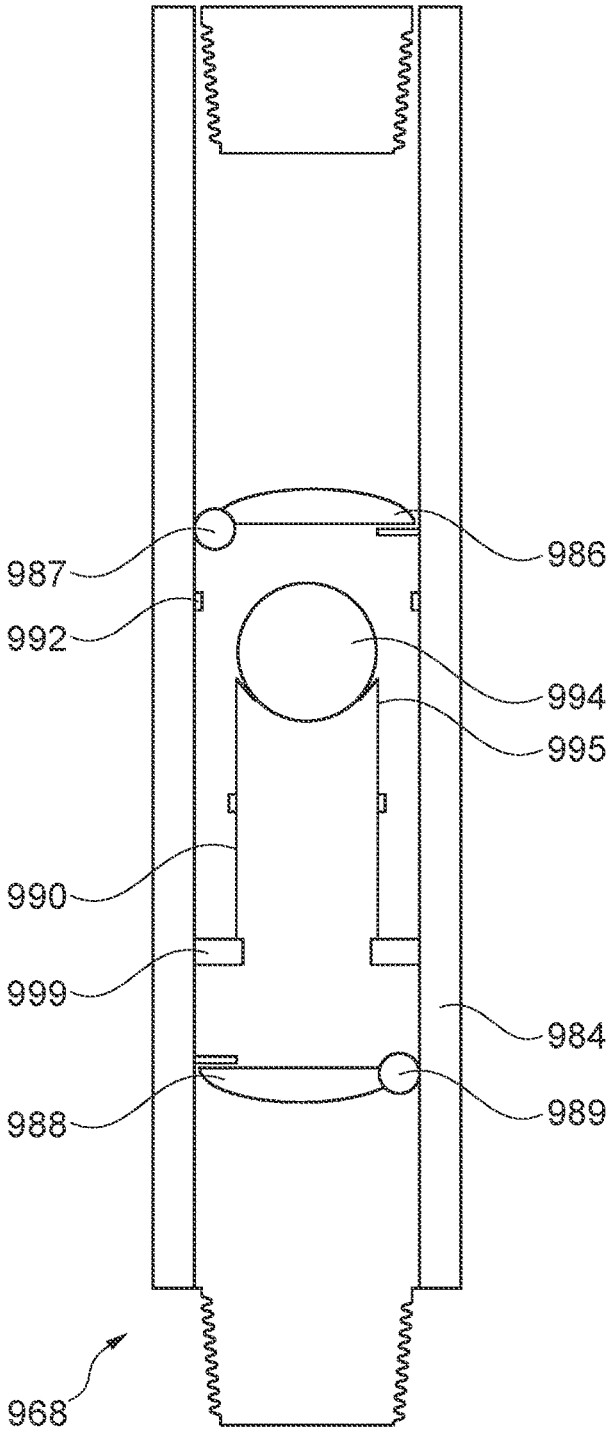
FIG. 11 schematically illustrates the retention valve of FIG. 9 in a third configuration, in accordance with one or more embodiments.

As such, FIG. 10 schematically illustrates the retention valve 968 in a second configuration, in accordance with one or more embodiments. Here, in order to close the upper valve 986, activation ball 994 deploys (e.g., is pumped downwardly against the general flow of the valve 968) to engage with a ball seat 995 at an upper portion of the locking sleeve 990. As shown, the locking sleeve 990 initially holds the upper valve 986 in the open position. However, as the activation ball 994 continues to be forced downwardly, it pushes the locking sleeve 990 downwardly with sufficient force to break the shear pin 992; this is illustrated in FIG. 11 (in a third configuration of retention valve 968). Downward movement of the locking sleeve 990 is then stopped by an annular stopper 999 which is fixedly mounted at the inner surface of valve housing 984. The lower valve 988 remains in its closed position during this process. It should be appreciated that dimensions of the activation ball 994 should be sufficiently small as to pass through retractable tubing (e.g., the tubing 150 shown in FIG. 1) and other components such as a motor head assembly (e.g., as indicated at 166 in FIG. 1). Generally, it should be understood that the activation ball 994 can sufficiently deploy downwardly via gravity, and as assisted by a relatively low degree of pumping (as may be deemed suitable or sufficient).

Figure 12:
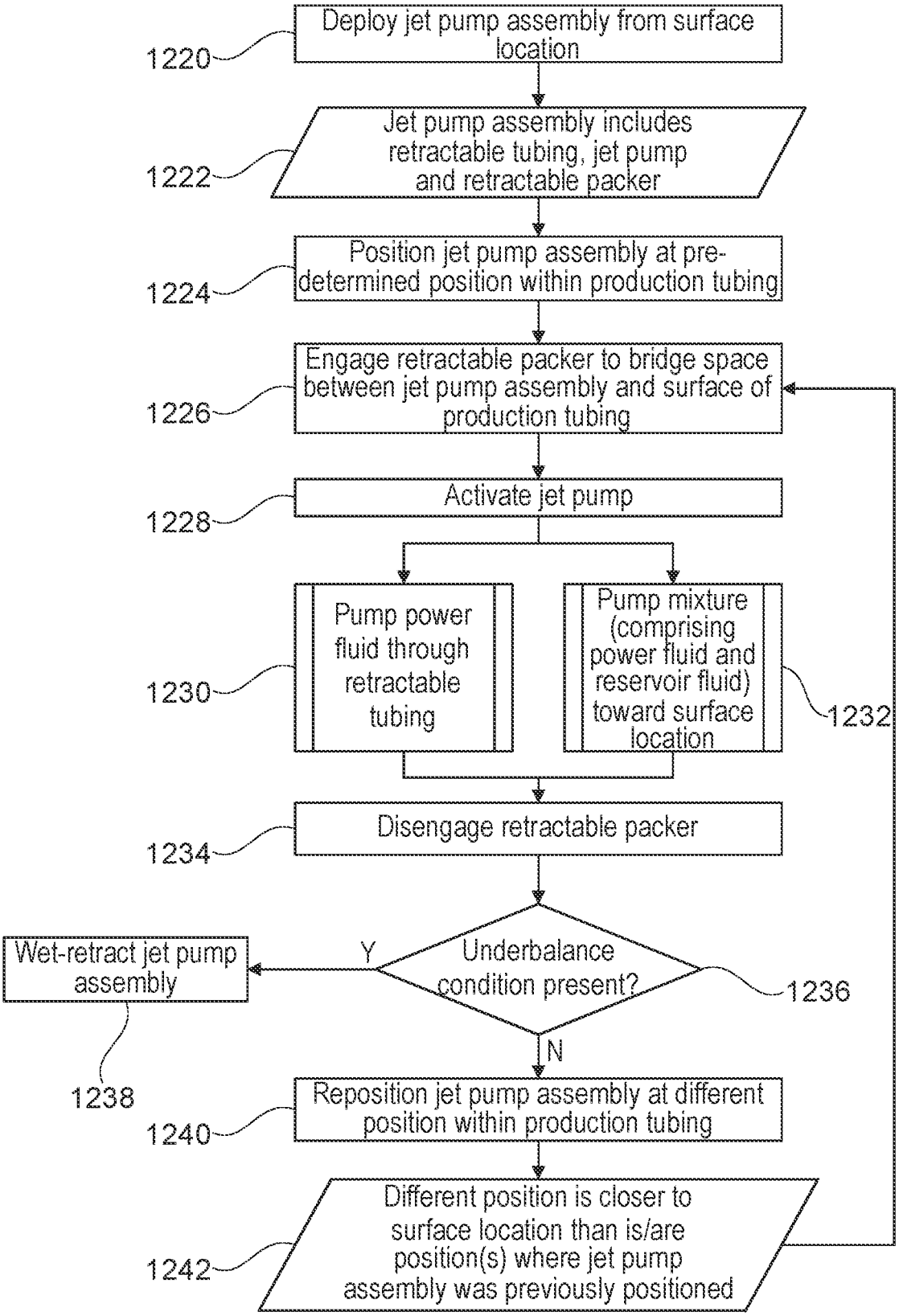
FIG. 12 shows a flowchart of a method in accordance with one or more embodiments.

FIG. 12 shows a flowchart of a method, as a general overview of steps which may be carried out in accordance with one or more embodiments described or contemplated herein. As an illustrative and non-restrictive example, the steps shown in FIG. 12 may correspond to the first, second, third, fourth and seventh conditions of a system as described and illustrated herein with respect to FIGS. 2-5 and 8, in addition to a step of "wet-retraction" as defined and discussed herein.

As such, in accordance with one or more embodiments, a jet pump assembly is deployed from a surface location (1220), wherein the jet pump assembly includes retractable tubing, a jet pump and a retractable packer (1222). The jet pump assembly is positioned at a predetermined position within the production tubing (1224). The retractable packer is engaged to bridge a space between the jet pump assembly and a surface of the production tubing (1226), and the jet pump is activated to: pump a power fluid through the retractable tubing (1230); and pump toward the surface location a mixture comprising the power fluid and reservoir fluid (1232). The retractable packer is disengaged (1234), and a determination is made as to whether there is an underbalance condition, where a reservoir pressure exceeds a hydrostatic pressure from the mixture (1236). If an underbalance condition is determined to be present, the jet pump assembly is wet-retracted from the production tubing (e.g., as defined and discussed herein) (1238). (By way of illustrative example, such wet-retraction can be facilitated in a manner as defined and discussed herein, e.g., by way of a bi-directional valve arrangement as described and illustrated with respect to FIGS. 9-11). If an underbalance condition is not determined to be present, the jet pump assembly is repositioned at a second position within the production tubing (1240), wherein the second position is closer to the surface location than is the first position (1242).

Figure 13:
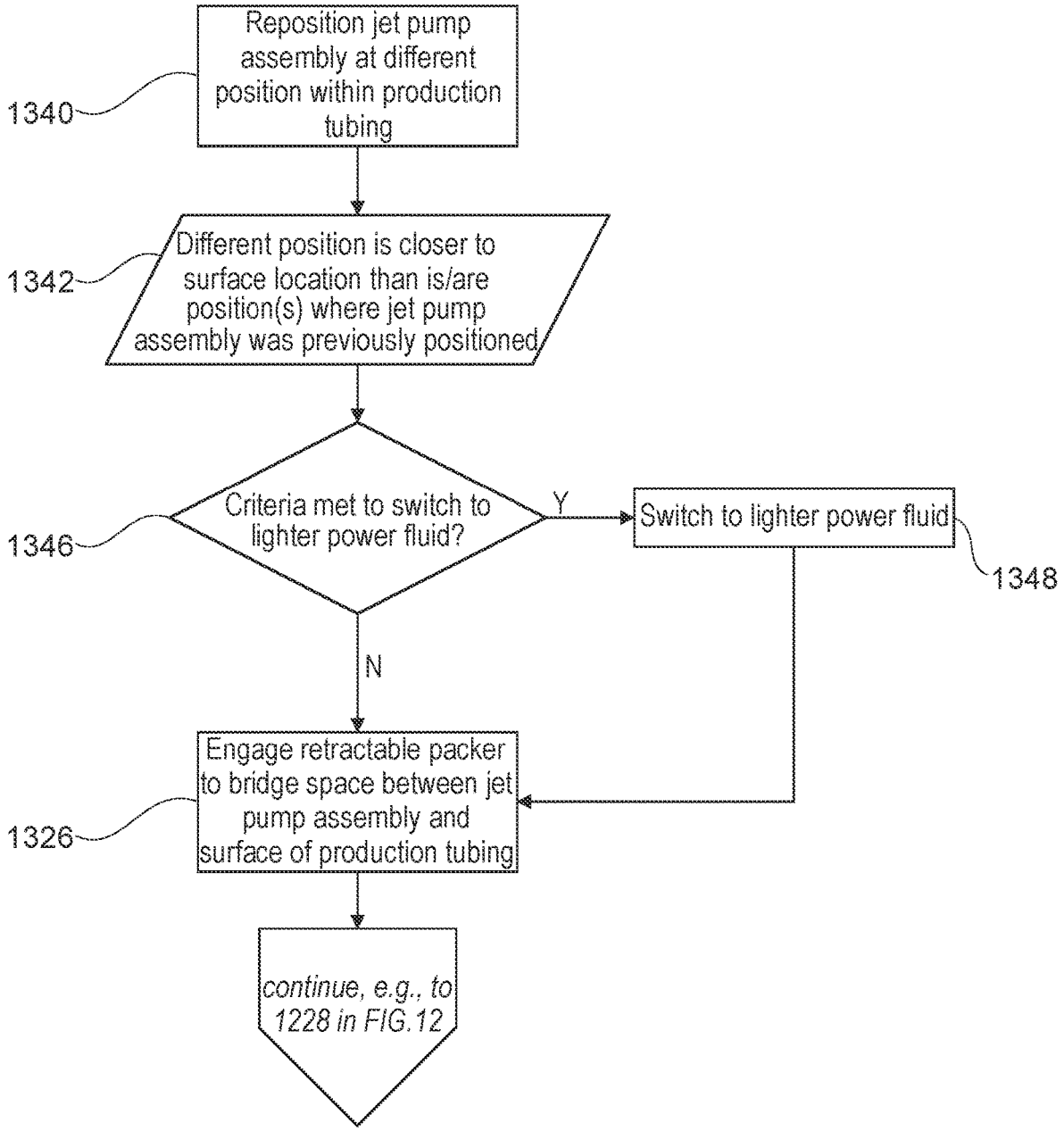
FIG. 13 shows a flowchart of alternative method steps in accordance with one or more embodiments.

FIG. 13 shows a flowchart of alternative method steps in accordance with one or more embodiments. As an illustrative and non-restrictive example, the steps shown in FIG. 12 may correspond to the fifth and sixth conditions of a system as described and illustrated herein with respect to FIGS. 6 and 7.

As such, in accordance with one or more embodiments, a jet pump assembly is repositioned at a different position within production tubing (1340), e.g., after a determination is made that an underbalance condition is not present (as defined and discussed herein). (This step may be considered as being analogous to step 1240 described and illustrated herein with respect to FIG. 12.) The different position is closer to a surface location than is/are positions where the jet pump assembly was previously positioned (1342). Thus, merely by way of illustrative example, the "different position" may be a second or third position or depth within production tubing as discussed herein.

In accordance with one or more embodiments, a determination is made as to whether criteria are met to switch to a lighter power fluid (1346). If such criteria are met, then a lighter power fluid (e.g., diesel) is switched in for an existing power fluid in the system (1348). Thereafter, or after a determination is made that criteria for switching to the lighter power fluid are not met, a retractable packer is engaged to bridge a space between the jet pump assembly and a surface of the production tubing (1326). Merely by way of illustrative example, the process may then continue with steps analogous to those described and illustrated with respect to 1228 and onward in FIG. 12.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A method comprising:

deploying a jet pump assembly from a surface location into production tubing in a wellbore at a depleted volatile oil reservoir, wherein the jet pump assembly includes:

retractable tubing; and a downhole assembly disposed at a free end of the retractable tubing, the downhole assembly including:

a jet pump and a retractable packer; and a valve arrangement operatively disposed between the free end of the retractable tubing and the jet pump;

positioning the jet pump assembly at a predetermined first position within the production tubing;

engaging the retractable packer to bridge a space between the jet pump assembly and a surface of the production tubing;

activating the jet pump to:

pump a power fluid through the retractable tubing; and pump toward the surface location a mixture comprising the power fluid and reservoir fluid;

disengaging the retractable packer;

determining whether there is an underbalance condition;

upon determining an underbalance condition to be present, wet-retracting the jet pump assembly from the production tubing, wherein the retractable tubing is retracted and the valve arrangement retains the power fluid within the retractable tubing; and upon determining an underbalance condition not to be present, repositioning the jet pump assembly at a second position within the production tubing, wherein the second position is closer to the surface location than is the first position.

2. The method according to claim 1, further comprising deactivating the jet pump prior to or upon disengaging the retractable packer.

3. The method according to claim 2, further comprising, upon said repositioning of the jet pump assembly:

engaging the retractable packer to bridge a space between the jet pump assembly and a surface of the production tubing;

pumping the power fluid through the retractable tubing; and pumping toward the surface location a second mixture comprising the power fluid and reservoir fluid.

4. The method according to claim 3, further comprising:

determining whether there is an underbalance condition at the second position, where a reservoir pressure exceeds a hydrostatic pressure from the second mixture; and upon determining an underbalance condition not to be present at the second position, repositioning the jet pump assembly at a third position within the production tubing, wherein the third position is closer to the surface location than is the second position.

5. The method according to claim 1, further comprising:

based on one or more predetermined criteria, replacing the power fluid with a lighter power fluid once the jet pump assembly is repositioned at the second position and/or at another position that is closer to the surface location than the first position.

6. The method according to claim 1, wherein:

the first position is at a first depth with respect to the surface location; and the second position is at a second depth with respect to the surface location;

wherein the second depth is closer to the surface location than is the first depth.

7. The method according to claim 1, wherein the retractable tubing comprises coiled tubing.

8. The method according to claim 1, wherein:

the valve arrangement comprises a bi-directional valve arrangement that includes:

a housing; and an upper valve and a lower valve each mounted within the housing; and the wet-retracting comprises:

setting the upper valve to an open position and the lower valve to a closed position; and displacing the upper valve from the open position to a closed position, while the lower valve remains in the closed position, whereby, when the retractable tubing is retracted with the upper valve and the lower valve both in the closed position, power fluid does not progress back from the retractable tubing into the wellbore.

9. The method according to claim 8, wherein the displacing of the upper valve comprises:

biasing the upper valve to deploy from the open position to the closed position;

holding the upper valve in the open position; and releasing the holding of the upper valve, and permitting the upper valve to displace from the open position to the closed position.

* * * * *